US007654357B2

(12) United States Patent
Buell et al.

(10) Patent No.: US 7,654,357 B2
(45) Date of Patent: Feb. 2, 2010

(54) RADIATOR COIL MOUNTED ON A MOTORCYCLE

(75) Inventors: Erik F. Buell, Mukwonago, WI (US); John W. Fox, Mukwonago, WI (US); Matthew J. Sheahan, Milwaukee, WI (US)

(73) Assignee: Buell Motorcycle Company, East Troy, WI (US)

( * ) Notice: Subject to any disclaimer, the term of this patent is extended or adjusted under 35 U.S.C. 154(b) by 217 days.

(21) Appl. No.: 11/772,534

(22) Filed: Jul. 2, 2007

(65) Prior Publication Data

US 2009/0008182 A1 Jan. 8, 2009

(51) Int. Cl.
*B62D 61/02* (2006.01)

(52) U.S. Cl. ..... 180/229; 180/68.4

(58) Field of Classification Search ..... 180/229, 180/68.4, 68.6
See application file for complete search history.

(56) References Cited

U.S. PATENT DOCUMENTS 3,578,285 A 5/1971 Carlton
3,811,650 A 5/1974 Dehar
4,193,575 A 3/1980 Burgess
4,428,451 A 1/1984 Yamaoka
4,478,306 A 10/1984 Tagami
4,512,547 A 4/1985 Balch
4,570,740 A * 2/1986 Hara ..... 180/229
4,618,020 A 10/1986 Noda et al.
4,637,486 A 1/1987 Iwai
4,709,774 A 12/1987 Saito et al.
4,717,119 A 1/1988 Trin
4,793,293 A 12/1988 Minami
4,953,631 A 9/1990 Kimura
5,176,111 A 1/1993 Nakamura et al.
5,219,016 A * 6/1993 Bolton et al. ..... 165/41
5,269,243 A 12/1993 Mochizuki
5,566,746 A 10/1996 Reise
5,715,778 A 2/1998 Hasumi et al.
5,992,554 A 11/1999 Hasumi et al.
6,332,505 B1 12/2001 Tateshima et al.
6,422,182 B1 7/2002 Ohta
6,695,088 B2 2/2004 Schroeder
6,830,238 B1 12/2004 Kesselring
7,077,230 B2 7/2006 Arnold
7,143,854 B2 * 12/2006 Arnold ..... 180/229
7,188,696 B2 * 3/2007 Arnold ..... 180/229
7,358,003 B2 * 4/2008 Imaseki et al. ..... 429/28
7,404,463 B2 * 7/2008 Saiki et al. ..... 180/68.4
7,448,461 B2 * 11/2008 Misaki et al. ..... 180/68.4
2001/0004011 A1 * 6/2001 Hasumi ..... 165/125

(Continued)

*Primary Examiner*—Lesley D Morris
*Assistant Examiner*—Tashiana Adams
(74) *Attorney, Agent, or Firm*—Michael Best & Friedrich LLP

(57) ABSTRACT

A motorcycle including a frame having a top, a bottom, a front, a rear, and a centrally-located longitudinal axis extending through the front and the rear. The longitudinal axis defines a vertical plane. The motorcycle also includes an engine supported by the frame and a radiator coil obliquely mounted to the frame. The radiator coil is spaced apart from the vertical plane and includes a forward end and a rearward end as viewed from above the motorcycle. The forward end defines a first distance measured normal to the vertical plane and the rearward end defines a second distance measured normal to the vertical plane. The first distance is shorter than the second distance.

8 Claims, 5 Drawing Sheets

U.S. PATENT DOCUMENTS

2003/0066697 A1 4/2003 Kodan et al.
2005/0178597 A1* 8/2005 Arnold ..... 180/229
2005/0217909 A1* 10/2005 Guay et al. ..... 180/68.4
2006/0065455 A1* 3/2006 Saiki et al. ..... 180/68.4
2006/0254844 A1* 11/2006 Nakashima et al. ..... 180/229
2008/0156566 A1* 7/2008 Oohashi et al. ..... 180/229

* cited by examiner

RADIATOR COIL MOUNTED ON A MOTORCYCLE

BACKGROUND

The present invention relates to a motorcycle, and particularly to a radiator coil mounted on a motorcycle.

Motorcycles commonly include a radiator coil in communication with an engine of the motorcycle to facilitate cooling of the engine. A liquid coolant (e.g., water, ethylene glycol, etc.) circulates from the radiator coil toward the engine to remove heat from parts of the engine. The coolant then flows back to the radiator coil and is cooled by air passing over the radiator coil.

SUMMARY

In one embodiment, the invention provides a motorcycle including a frame having a top, a bottom, a front, a rear, and a centrally-located longitudinal axis extending through the front and the rear. The longitudinal axis defines a vertical plane. The motorcycle also includes an engine supported by the frame and a radiator coil obliquely mounted to the frame. The radiator coil is spaced apart from the vertical plane and includes a forward end and a rearward end as viewed from above the motorcycle. The forward end defines a first distance measured normal to the vertical plane and the rearward end defines a second distance measured normal to the vertical plane. The first distance is shorter than the second distance.

In another embodiment, the invention provides a motorcycle including a frame having a front, a rear, and a centrally-located longitudinal axis extending through the front and the rear. The longitudinal axis defines a vertical plane. The motorcycle also includes an engine supported by the frame, a radiator coil coupled to the frame and spaced apart from the vertical plane, and a shroud coupled to the frame and at least partially surrounding the radiator coil. The shroud is configured to direct an airflow through the radiator coil and toward the vertical plane as the airflow passes in the rearward direction.

In yet another embodiment, the invention provides a method of directing an airflow through a motorcycle. The motorcycle includes a frame having a front, a rear, and a centrally-located longitudinal axis extending through the front and the rear. The motorcycle also includes an engine supported by the frame, a radiator coil coupled to the frame and spaced apart from the vertical plane, and a shroud coupled to the frame and at least partially surrounding the radiator coil. The method includes directing the airflow into the shroud, directing the airflow in the shroud toward the radiator coil, and directing the airflow through the radiator coil toward the vertical plane.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
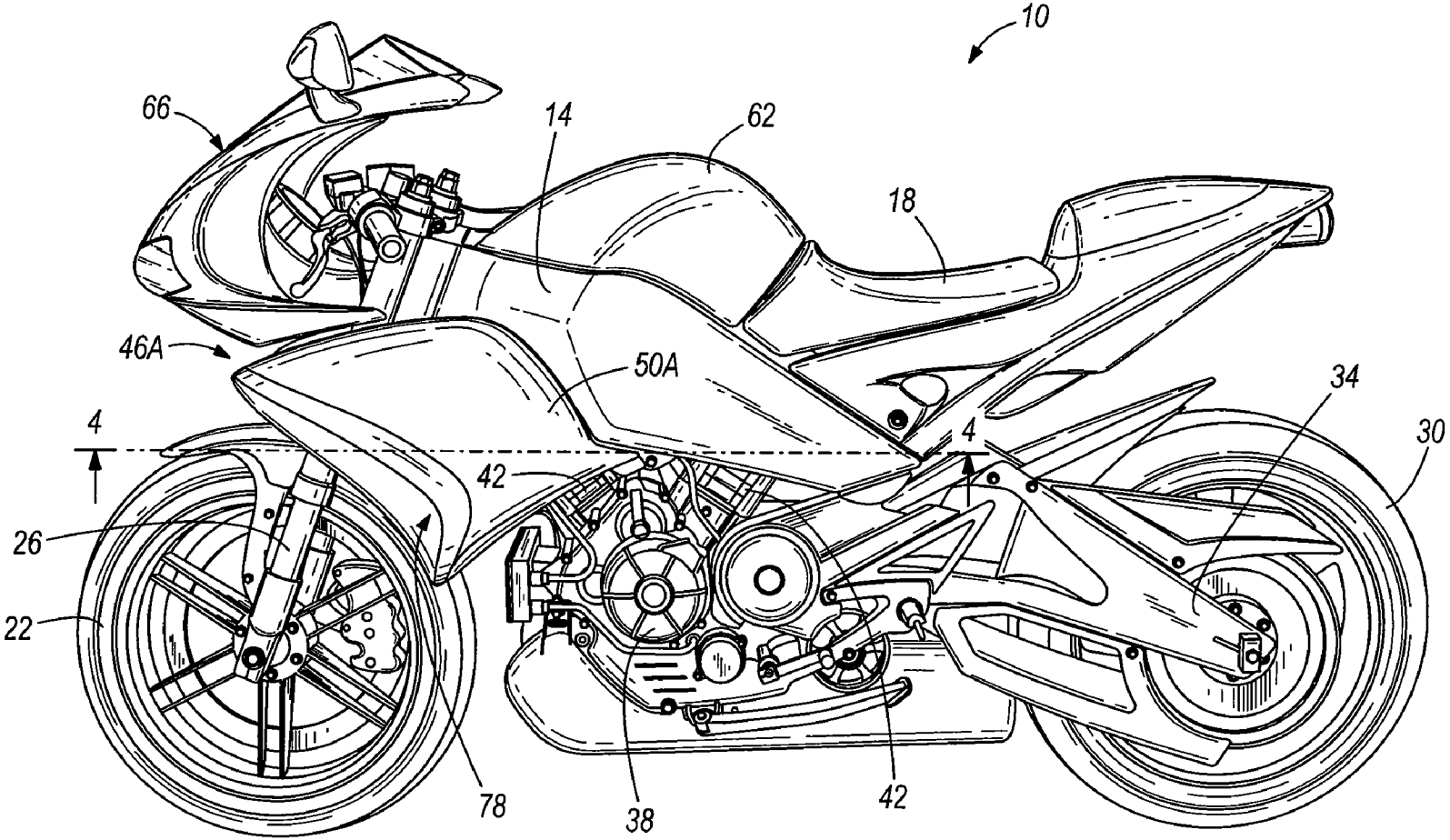
FIG. 1 is a side view of a motorcycle embodying the invention.

FIG. 1 illustrates a motorcycle 10 including a frame 14, a seat 18, a front wheel 22 supported by a front fork 26, a rear wheel 30 supported by a swing arm 34, and an engine 38. The engine 38 provides power to the rear wheel 30 through a transmission and includes two cylinders 42 for combusting an air-fuel mixture. In the illustrated embodiment, a portion of the frame 14 comprises a fuel tank assembly that stores fuel within the frame 14.

Figure 2:
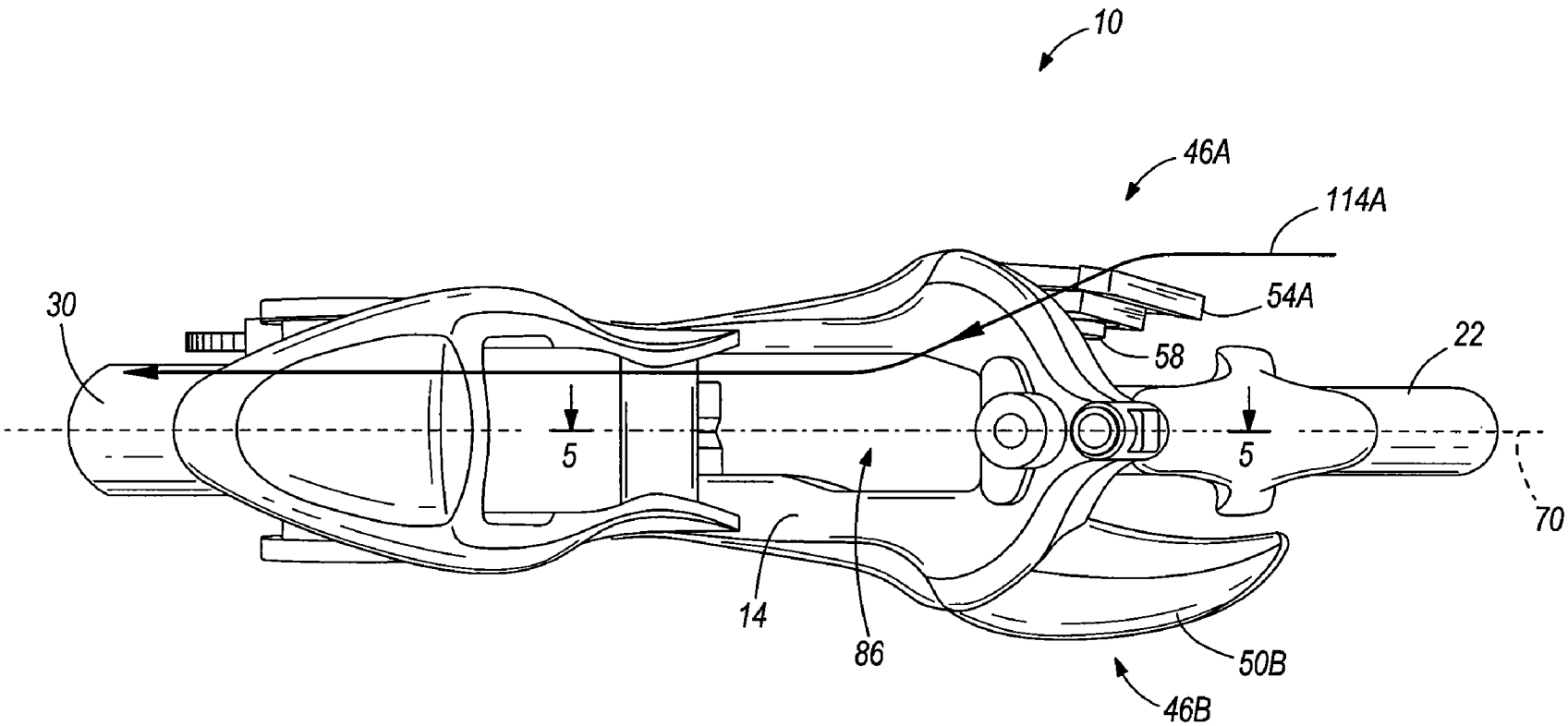
FIG. 2 is a partial top view of the motorcycle shown in FIG. 1.

The illustrated motorcycle 10 also includes two radiator assemblies 46A, 46B coupled to the sides of the frame 14. As shown in FIGS. 1 and 2, the radiator assemblies 46A, 46B are positioned proximate to the front of the motorcycle 10 and symmetrically mounted on opposite sides of the frame 14. Each radiator assembly 46A, 46B is positioned at a height substantially equal to the top half of the engine 38. In addition, each radiator assembly 46A, 46B includes a shroud 50A, 50B, a radiator coil 54A, 54B (FIGS. 2 and 4) positioned within the shroud 50A, 50B, and a fan assembly 58 (FIG. 5) coupled to the radiator coil 54A, 54B.

FIG. 2 illustrates the motorcycle 10 with the seat 18, an airbox 62, a windshield/control assembly 66, and the engine 38 removed. In addition, one of the shrouds 50A is removed such that the corresponding radiator coil 54A is visible. The illustrated frame 14 includes a centrally-located longitudinal axis 70 extending through the front wheel 22 and the rear wheel 30. In the illustrated embodiment, the motorcycle 10 is configured such that the engine 38 is positioned substantially on the longitudinal axis 70. The longitudinal axis 70 defines a vertical plane 74 (FIG. 3) that extends through a top and a bottom of the motorcycle 10 and that divides the motorcycle 10 into two halves.

The illustrated shrouds 50A, 50B substantially cover and protect the radiator coils 54A, 54B while still allowing air to enter and flow over the radiator coils 54A, 54B. Each shroud 50A, 50B includes an opening 78 which is oriented generally in a forwardly-facing direction on the motorcycle 10 so that air can enter the shroud 50A, 50B and flow over and/or through the corresponding radiator coil 54A, 54B. A second, inwardly-facing opening 82 (FIGS. 4 and 5) is positioned at the opposite end of each shroud 50A, 50B so that the air can flow into a central cavity 86 of the frame 14 (i.e., where the engine 38 is generally located) after passing the radiator coil 54A, 54B.

Figure 3:
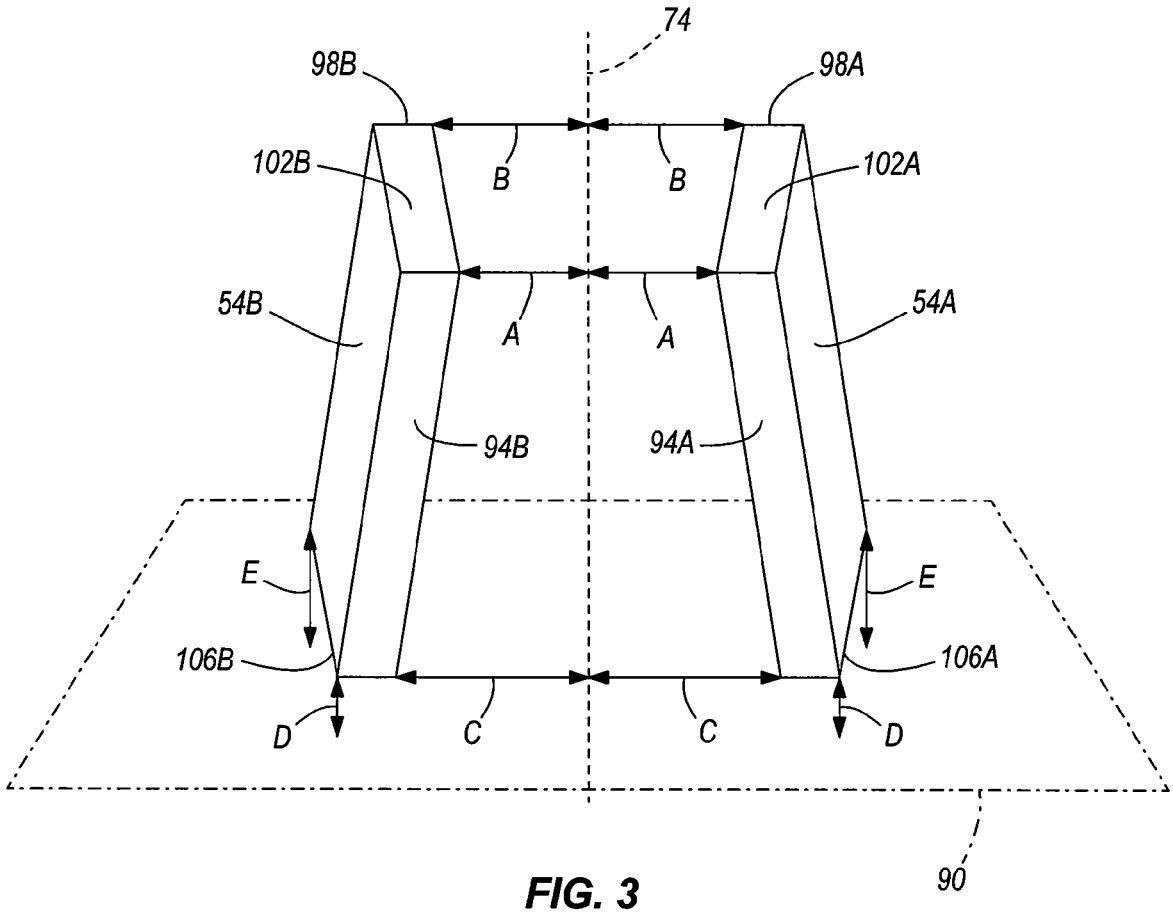
FIG. 3 schematically illustrates radiator coils viewed from the front of the motorcycle of FIG. 1.

The illustrated radiator coils 54A, 54B are spaced apart from the vertical plane 74 and are obliquely mounted to the frame 14 within the shrouds 50A, 50B. Referring to FIG. 3, the orientation of the radiator coils 54A, 54B relative to the vertical plane 74 and to a horizontal plane 90 (i.e., a plane generally perpendicular to the vertical plane 74) is illustrated. In FIG. 3, the oblique mounting of the radiator coils 54A, 54B relative to the planes 74, 90 is slightly exaggerated to facilitate discussion of the radiator coil orientation. Each radiator coil 54A, 54B includes a forward end 94A, 94B, a rearward end 98A, 98B, a top edge 102A, 102B, and a bottom edge 106A, 106B. Overall, the radiator coils 54A, 54B are tipped forward, the forward ends 94A, 94B are turned inwardly (i.e., toward the vertical plane 74) relative to the rearward ends 98A, 98B, and the bottom edges 106A, 106B are turned outwardly (i.e., away from the vertical plane 74) relative to the top edges 102A, 102B to achieve the illustrated orientation.

As shown in FIG. 3, the illustrated radiator coils 54A, 54B are oriented such that the forward ends 94A, 94B are spaced a first distance A from the vertical plane 74 and the rearward ends 98A, 98B are spaced a second distance B from the vertical plane 74. The first distance A is less than the second distance B such that the forward ends 94A, 94B of the radiator coils 54A, 54B are turned toward the vertical plane 74.

In addition, at the forward end 94A, 94B of each radiator coil 54A, 54B, the top edge 102A, 102B is spaced the first distance A from the vertical plane 74 and the bottom edge 106A, 106B is spaced a third distance C from the vertical plane 74. The first distance A is less than the third distance C such that the top edge 102A, 102B of each radiator coil 54A, 54B is closer to the vertical plane 74 than the bottom edge 106A, 106B.

Furthermore, the forward end 94A, 94B of the bottom edge 106A, 106B is spaced a fourth distance D from the horizontal plane 90 and the rearward end 98A, 98B of the bottom edge 106A, 106B is spaced a fifth distance E from the horizontal plane 90. The fourth distance D is less than the fifth distance E such that the rearward end 98A, 98B of each radiator coil 54A, 54B is positioned generally higher than the forward end 94A, 94B.

The radiator coils 54A, 54B are in communication with cooling passages of the engine 38 to facilitate cooling of the engine 38. A liquid coolant (e.g., water, ethylene glycol, etc.) circulates between the radiator coils 54A, 54B and the engine 38 to transfer heat away from the engine 38. The liquid coolant absorbs heat at the engine 38 and flows into the radiator coils 54A, 54B. Air passes over and/or through the radiator coils 54A, 54B to remove heat from the liquid coolant by convection. When the motorcycle 10 is moving, the air is automatically directed by the shrouds 50A, 50B toward the respective radiator coils 54A, 54B. The fan assemblies 58 are mounted directly to an interior side of the radiator coils 54A, 54B (e.g., adjacent to inner portions 110 of the shrouds 50A, 50B) to generate a forced airflow through the radiator coils 54A, 54B when, for example, the engine 38 is idling and/or the motorcycle 10 is traveling at a relatively low speed.

Figure 4:
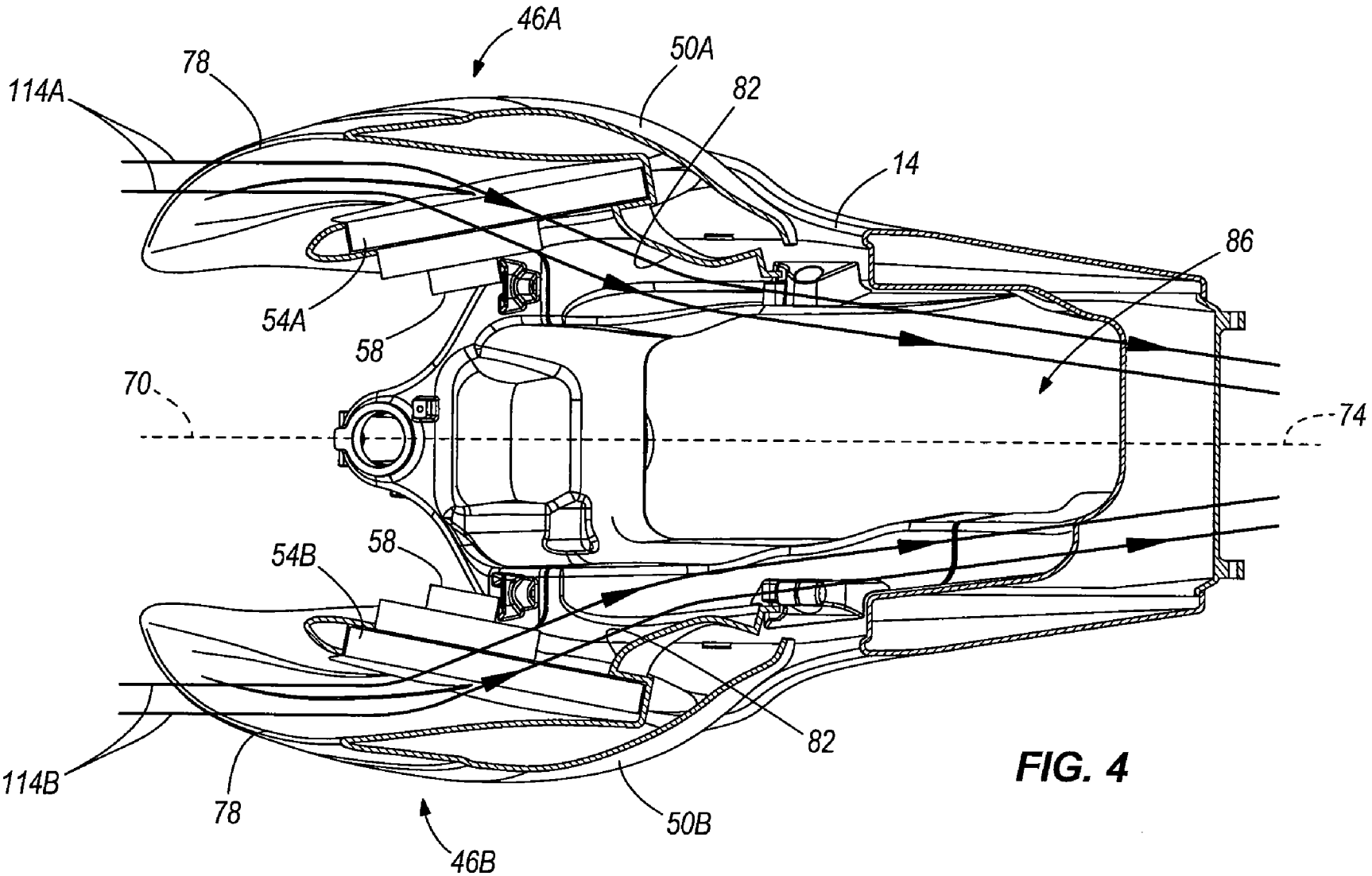
FIG. 4 is a cross-sectional view taken along line 4-4 of FIG. 1.

Referring back to FIG. 2, an airflow 114A through the motorcycle 10 is shown. In FIG. 2, only one airflow 114A passing through one radiator coil 54A and side of the motorcycle 10 is shown. However, as shown in FIG. 4, it should be readily apparent that another airflow 114B (FIG. 4) flows through the other radiator coil 54B and side of the motorcycle 10 in a substantially similar, but mirrored, manner. As the motorcycle 10 is traveling in a forward direction, the airflow 114A enters the shroud 50A through the opening 78 of the shroud 50A. The illustrated airflow 114A flows into the shroud 50A and is directed over and/or through the radiator coil 54A. In situations where the engine 38 is idling or the motorcycle 10 is traveling at a low velocity, the fan assembly 58 (FIG. 5) draws the airflow 114A into the shroud 50A and through the radiator coil 54A. The orientation of the radiator coil 54A within the shroud 50A causes the airflow 114A to be directed toward the vertical plane 74. As such, the illustrated airflow 114A is directed through the second opening 82 and into the central cavity 86. The airflow 114A then passes over a portion of the engine 38 and out the rear of the frame 14 (e.g., over the rear wheel 30).

Figure 5:
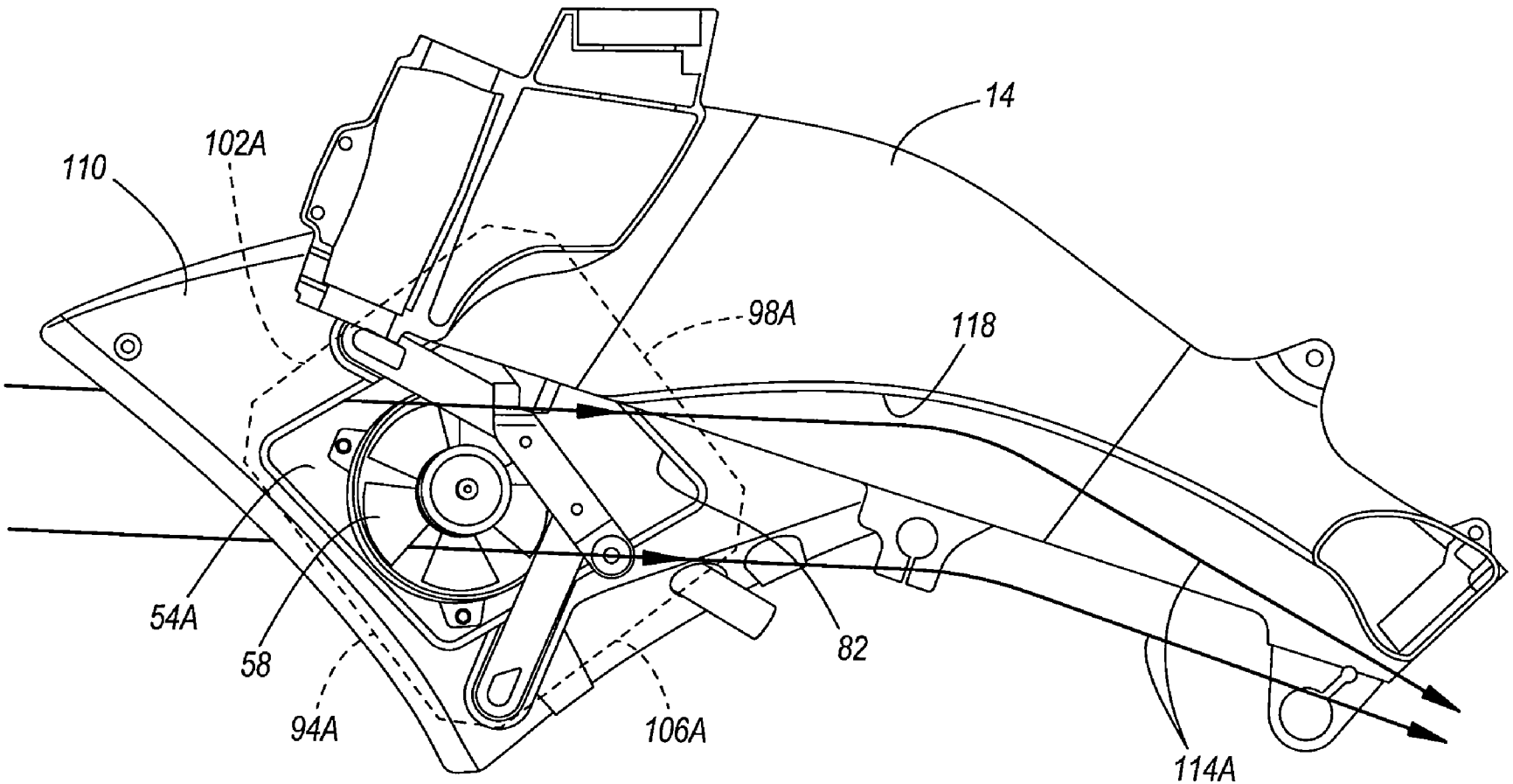
FIG. 5 is a side cross-sectional view of a portion of the motorcycle taken through section line 5-5 of FIG. 2.

FIGS. 4 and 5 illustrate the airflow 114A through portions of the motorcycle 10 in more detail. As shown in FIG. 4, the airflow 114A enters the corresponding shroud 50A in a direction substantially parallel to the vertical plane 74. The illustrated airflow 114A travels through the corresponding radiator coil 54A and is directed toward the central cavity 86 and toward the vertical plane 74. When the airflow 114A reaches the central cavity 86, the airflow 114A is directed to flow in a direction parallel to, or almost parallel to, the vertical plane 74. In addition, as the airflow 114A enters the central cavity 86, the airflow 114A is directed substantially downwardly by a curved portion 118 of the frame 14, as shown in FIG. 5. The airflow 114A continues to flow through the central cavity 86 and over a portion of the engine 38. As shown in FIG. 4, the airflow 114A, 114B on each side of the motorcycle 10 passes through a different side of the central cavity 86 and, therefore, over a different portion of the engine 38. The airflow 114A continues through a rear portion of the frame 14 to flow out of the motorcycle 10. In the embodiment illustrated in FIG. 2, the airflow 114A exits the frame 14 by passing over the rear wheel 30 of the motorcycle 10. In other embodiments, the airflow 114A may be directed out a side of the frame 14 after passing over the engine 38.

The illustrated airflows 114A, 114B remove heat from the liquid coolant by flowing over and/or through the radiator coils 54A, 54B. In addition, the airflows 114A, 114B facilitate and supplement cooling of the engine 38 by passing over and contacting the engine 38 directly.

Various features and advantages of the invention are set forth in the following claims.

What is claimed is:

1. A motorcycle comprising:

a frame having a top, a bottom, a front, a rear, and a centrally-located longitudinal axis extending through the front and the rear, the longitudinal axis defining a vertical plane;

an engine supported by the frame; and a radiator coil obliquely mounted to the frame, the radiator coil spaced apart from the vertical plane and including a forward end and a rearward end as viewed from above the motorcycle, the forward end defining a first distance measured normal to the vertical plane and the rearward end defining a second distance measured normal to the vertical plane, the first distance being shorter than the second distance;

wherein the radiator includes a top edge and a bottom edge, and wherein the top edge is closer to the vertical plane than the bottom edge.

2. The motorcycle of claim 1, wherein the rearward end is positioned generally higher than the forward end.

3. The motorcycle of claim 1, wherein the radiator coil is positioned at a height substantially equal to the top half of the engine.

4. The motorcycle of claim 1, further comprising a shroud coupled to the frame and surrounding at least a portion of the radiator coil, the shroud having a forward end portion opening in a forward direction and a rearward end portion opening toward the longitudinal axis.

5. The motorcycle of claim 1, wherein the radiator coil is a first radiator coil, and wherein the motorcycle further comprises a second radiator coil obliquely mounted to the frame on an opposite side of the frame than the first radiator coil, the second radiator coil spaced apart from the vertical plane and including a forward end and a rearward end as viewed from the top of the motorcycle, the forward end of the second radiator coil defining a third distance measured normal to the vertical plane and the rearward end of the second radiator coil defining a fourth distance measured normal to the vertical plane, the third distance being shorter than the fourth distance.

6. The motorcycle of claim 5, wherein the rearward end of the first radiator coil is positioned generally higher than the forward end of the first radiator coil, and wherein the rearward end of the second radiator coil is positioned generally higher than the forward end second radiator coil.

7. The motorcycle of claim 5, wherein the second radiator coil includes a second top edge and a second bottom edge, the second top edge being closer to the vertical plane than the second bottom edge.

8. The motorcycle of claim 5, wherein the first radiator coil and the second radiator coil are symmetrically spaced apart from the vertical plane on opposite sides of the frame.

* * * * *